United States Patent [19]

Boyadjieff

[11] Patent Number: 4,605,077

[45] Date of Patent: Aug. 12, 1986

[54] TOP DRIVE DRILLING SYSTEMS

[75] Inventor: George I. Boyadjieff, Anaheim, Calif.

[73] Assignee: Varco International, Inc., Orange, Calif.

[21] Appl. No.: 677,988

[22] Filed: Dec. 4, 1984

[51] Int. Cl.[4] ..... E21B 19/16

[52] U.S. Cl. ..... 175/85; 175/52; 166/77.5; 166/85; 173/164

[58] Field of Search ..... 175/52, 57, 85; 166/77.5, 78, 85; 414/22; 173/164; 52/116

[56] References Cited

U.S. PATENT DOCUMENTS

| | | | |
|---|---|---|---|
| 3,280,920 | 10/1966 | Scott | 173/164 |
| 3,291,225 | 12/1966 | Foran | 173/164 |
| 3,312,294 | 4/1967 | Wilson | 175/85 |
| 3,404,741 | 10/1968 | Gheorghe et al. | 166/77.5 |
| 3,464,507 | 9/1969 | Alexander et al. | 175/85 |
| 3,920,087 | 11/1975 | Hisey et al. | 173/164 |
| 3,949,818 | 4/1976 | Russell | 173/164 |
| 4,128,135 | 12/1978 | Mitchhart et al. | 173/164 |
| 4,274,777 | 6/1981 | Scaggs | 414/22 |
| 4,421,179 | 12/1983 | Boyadjieff | 173/44 |
| 4,437,524 | 3/1984 | Boyadjieff et al. | 173/43 |
| 4,449,596 | 5/1984 | Boyadjieff | 175/85 |
| 4,458,768 | 7/1984 | Boyadjieff | 175/85 |
| 4,492,501 | 1/1985 | Haney | 414/22 |

*Primary Examiner*—Stephen J. Novosad

*Assistant Examiner*—Bruce M. Kisliuk

*Attorney, Agent, or Firm*—William P. Green

[57] ABSTRACT

Methods and apparatus for facilitating the drilling of a well with a top drive unit having a motor which is connected to the upper end of the drill string and moves upwardly and downwardly therewith. The methods and apparatus of the invention enable the drill string to be pulled upwardly off of the bottom of the well each time an additional length of drill pipe is added to the string, with the connection between that added length and the upper end of the string being made at an elevated location spaced above the rig floor. In one form of the invention, an elevated platform is provided on which a person may move to a location near the raised upper end of the string for assisting in making the connection, with that platform preferably being mounted to swing between a retracted position in which it remains during the drilling operation and an active position in which it projects to a point near the top of the string during the connecting process. In another form of the invention, the back-up tool for preventing rotation of the upper end of the string may be controlled remotely and be removable relative to the string between an active position in which it can grip the elevated upper end of the string and a retracted position in which it remains during drilling.

12 Claims, 20 Drawing Figures

FIG. 10
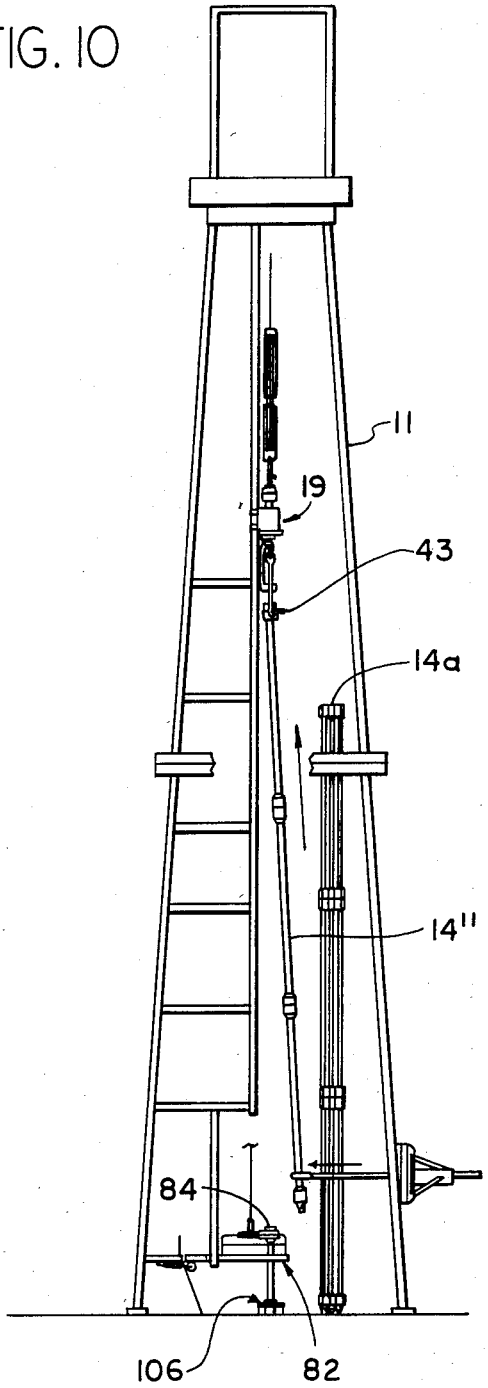
FIG. 11
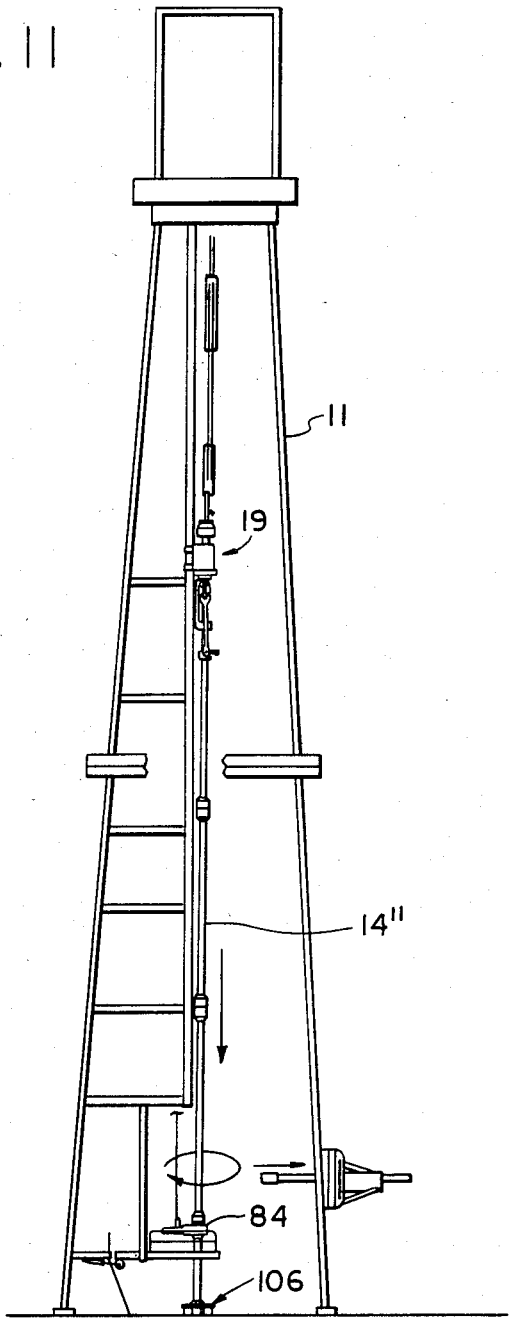
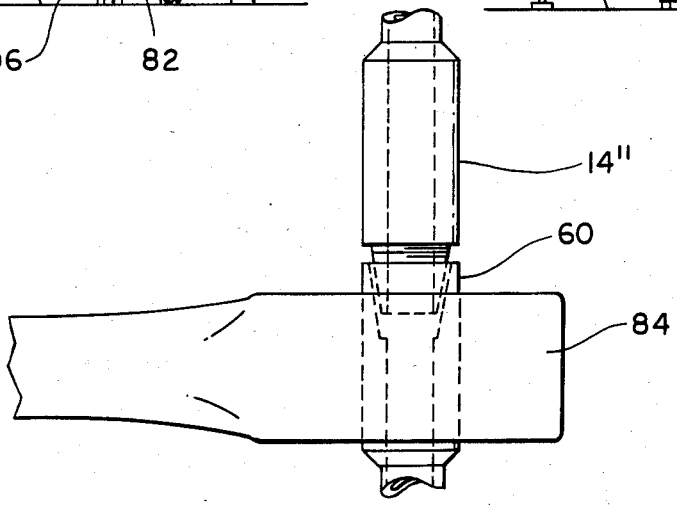
FIG. 12

FIG. 18
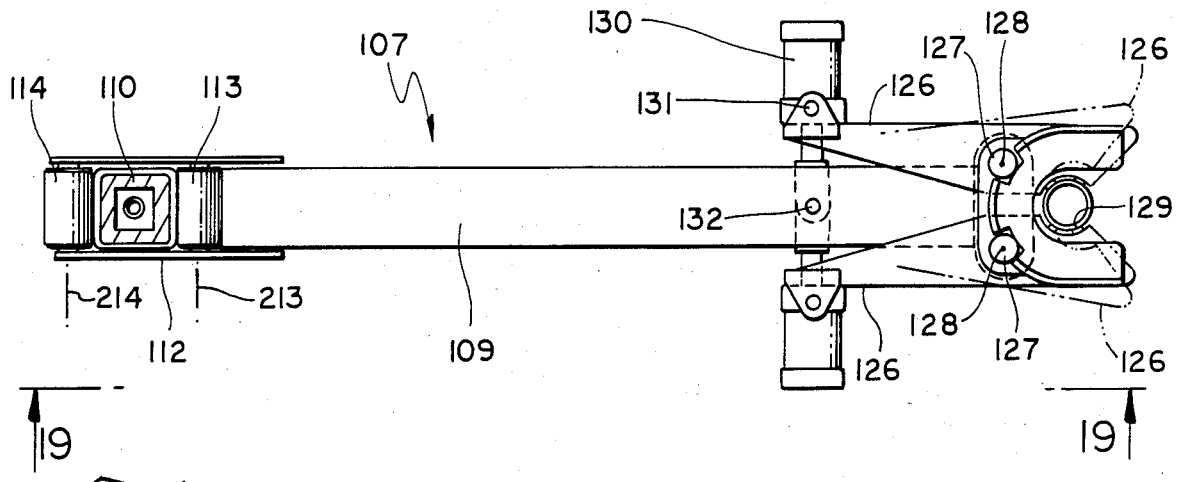
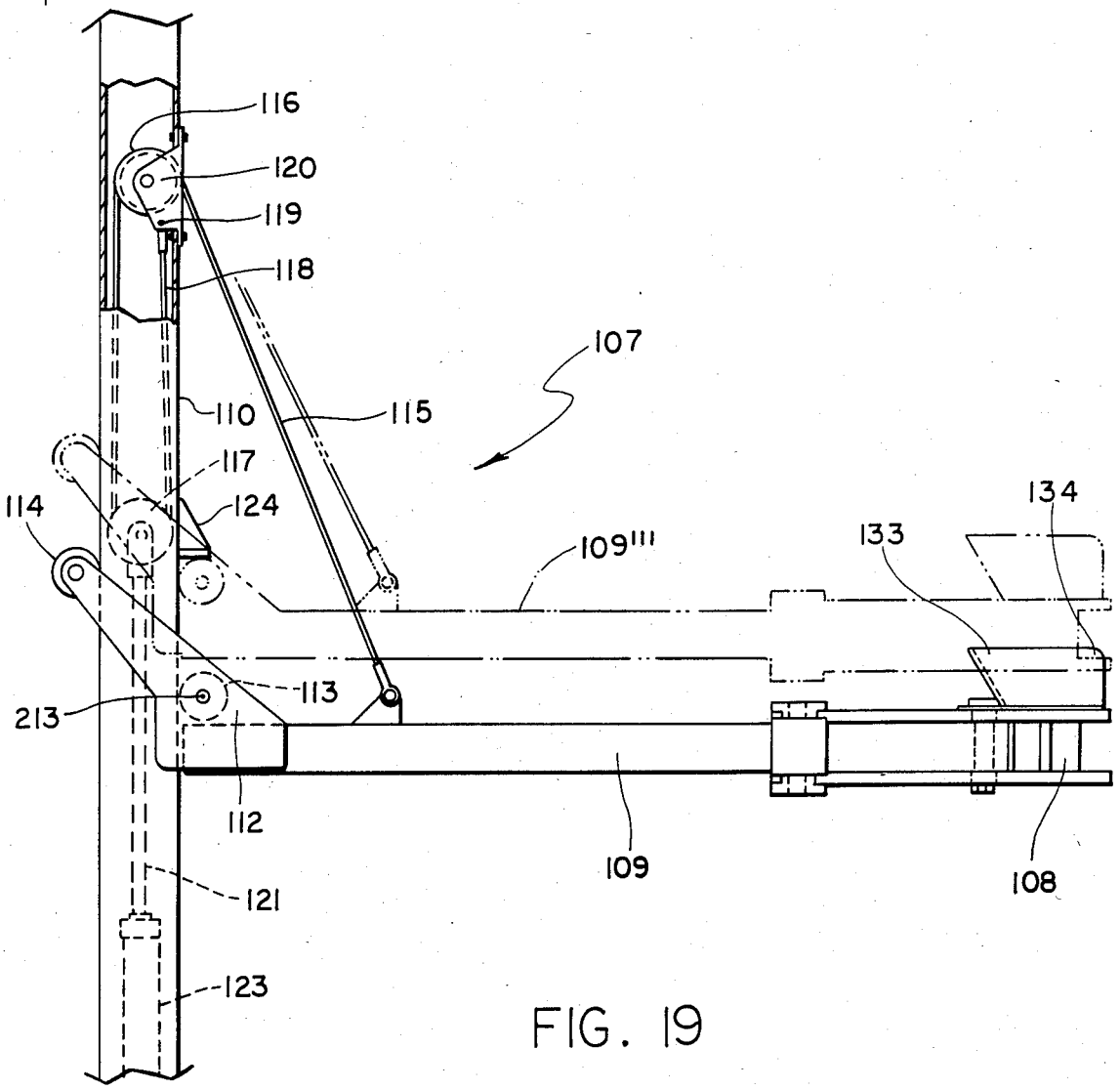
FIG. 19

TOP DRIVE DRILLING SYSTEMS

BACKGROUND OF THE INVENTION

This invention relates to improved methods and apparatus for drilling wells with a top drive drilling unit.

In a top drive drilling system, the motor which turns the drill string is connected to the upper end of the string and moves downwardly with the string during the drilling operation. Equipment of this type has enjoyed increasing popularity in recent years because it usually permits a substantial reduction in the overall cost of drilling as compared with the standard rotary system having a rotary table and kelly. However, for drilling in some areas the rotary table arrangement has had one advantage in that it requires the drill string to be pulled upwardly off of the bottom of the hole each time an added length of pipe is connected to the upper end of the string. This may reduce the possibility of the string becoming stuck in the hole, as may occur when a string remains on the bottom without rotation while adding pipe to its upper end. Also, when drilling an offshore well from a floating vessel, elevation of the string off of the bottom of the hole while adding pipe to the string prevents damage to the string or other equipment or the well by intermittent movement of the lower end of the string into and out of engagement with the bottom of the well as the vessel moves upwardly and downwardly with wave motion.

In top drive systems as previously utilized, it has not in most instances been possible to lift the string off of the bottom of the hole while adding pipe to the upper end of the string. For this reason some drillers have resisted use of top drive units in certain environments, such as for example in formations where there is a tendency to become stuck, or in floating vessel installations.

SUMMARY OF THE INVENTION

A purpose of the present invention is to provide improved methods and apparatus which overcome the above discussed disadvantages of prior top drive arrangements and allow a string driven by a top drive unit to be raised off of the bottom of the hole each time a length of pipe is added to the upper end of the string. In accordance with the invention, the string is raised to a position at which its upper threaded end to which the added length is to be connected is spaced substantially above the level of the rig floor, and is at a level at which it is not readily accessible to a person standing on the floor. A tong or other back-up tool engages the top of the string at that higher level and restrains it against rotation as the added length of pipe is connected threadedly to the upper end of the string.

In one form of the invention, a platform is provided at an elevated location spaced above the level of the rig floor, and is adapted to support a person at that location to assist in making up a threaded connection between the raised upper end of the drill string and the lower end of the length of pipe being added thereto. The person may then manually move a back-up tong from a storage location at a side of the well to a position of engagement with the raised upper end of the drill string. Preferably, the platform is itself mounted for movement between an active position of reception adjacent the upper end of the drill string and a retracted inactive position in which it does not interfere with movement of the string and top drive unit during the drilling process. This movement of the platform may be relative to a walkway located near the platform and onto which a person may walk when the platform is in its retracted condition.

In a second form of the invention, the back-up tool is mounted for movement between an active position in which it engages and restrains rotation of the upper end of the drill string at the specified elevated location and a retracted position in which it is offset to a side of the string to avoid interference with the string and top drive unit during the actual drilling operation. The back-up tool is preferably mounted to the end of an arm which swings between an upwardly projecting condition in the retracted position of the tool and a horizontally projecting condition in the active position of the tool.

BRIEF DESCRIPTION OF THE DRAWINGS

The above and other features and objects of the invention will be better understood from the following detailed description of the typical embodiments illustrated in the accompanying drawings in which:

FIG. 10 illustrates the top drive unit as it is connected to the upper end of a length of pipe to be added to the string;

FIG. 11 shows a next step in the method, in which the added length of pipe suspended by the top drive drilling unit is being lowered and stabbed into engagement with the upper end of the drill string;

FIG. 12 illustrates the lower end of the added length of pipe after connection to the upper end of the string;

FIG. 18 is an enlarged horizontal section taken on line 18—18 of FIG. 15; and FIG. 19 is a side view taken on line 19—19 of FIG. 18.

DESCRIPTION OF THE PREFERRED EMBODIMENTS

Figure 1:
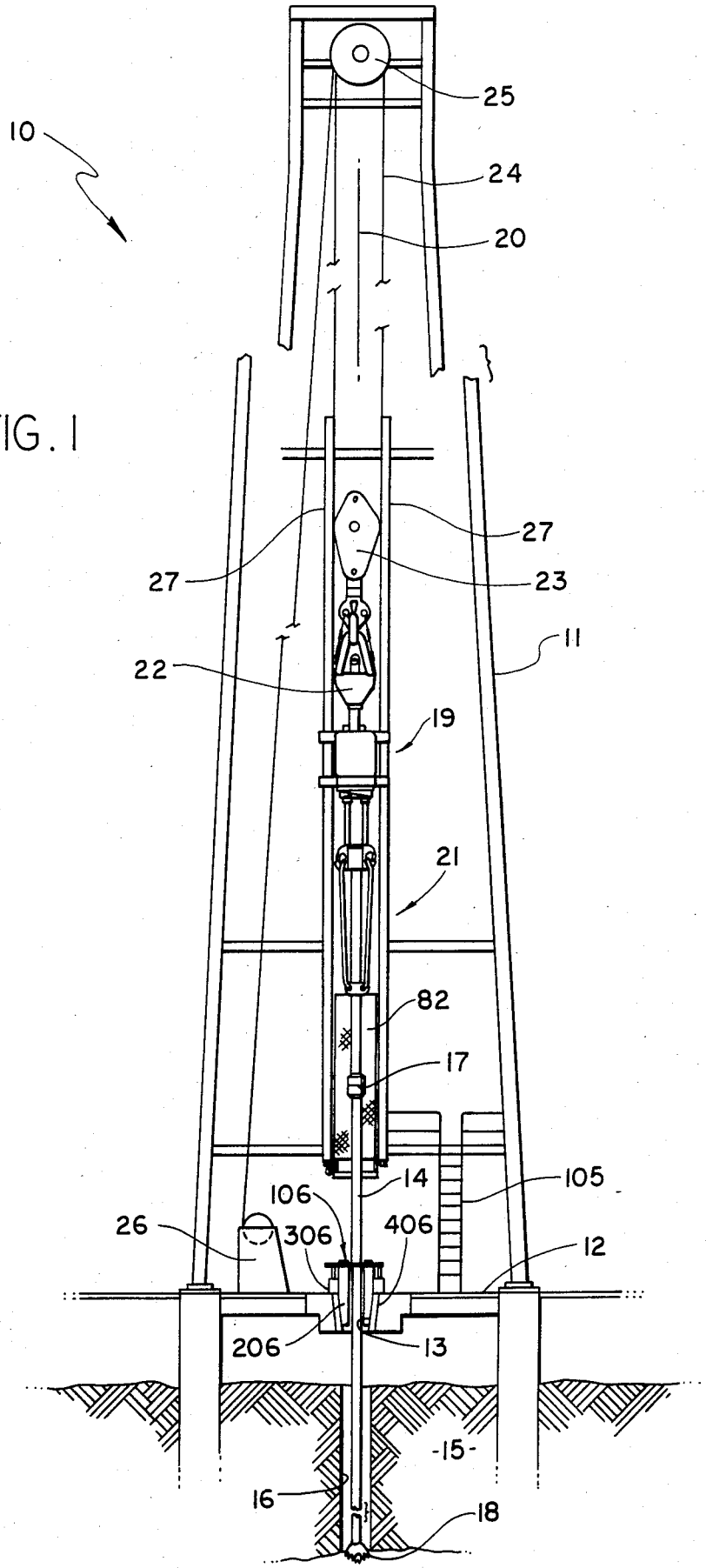
FIG. 1 is a somewhat diagrammatic representation of a top drive drilling system embodying the invention.

Referring first to FIG. 1, the rig 10 shown in that figure includes a derrick 11 having a rig floor 12 at its lower end containing an opening 13 through which drill string 14 extends downwardly into the earth 15 to drill a well 16. The drill string is formed in the usual manner of a large number of pipe sections interconnected at threaded joints 17 and having a bit 18 at the lower end of the string. The string is driven rotatively by a top drive drilling unit 19 which is connected to the upper end of the string and moves upwardly and downwardly therewith along the vertical axis 20 of the well. A pipe handler assembly 21 is suspended from the drilling unit, and is operable to suspend the string or a section of pipe in some conditions and to make and break threaded connections at the bottom of the drilling unit.

Figure 2:
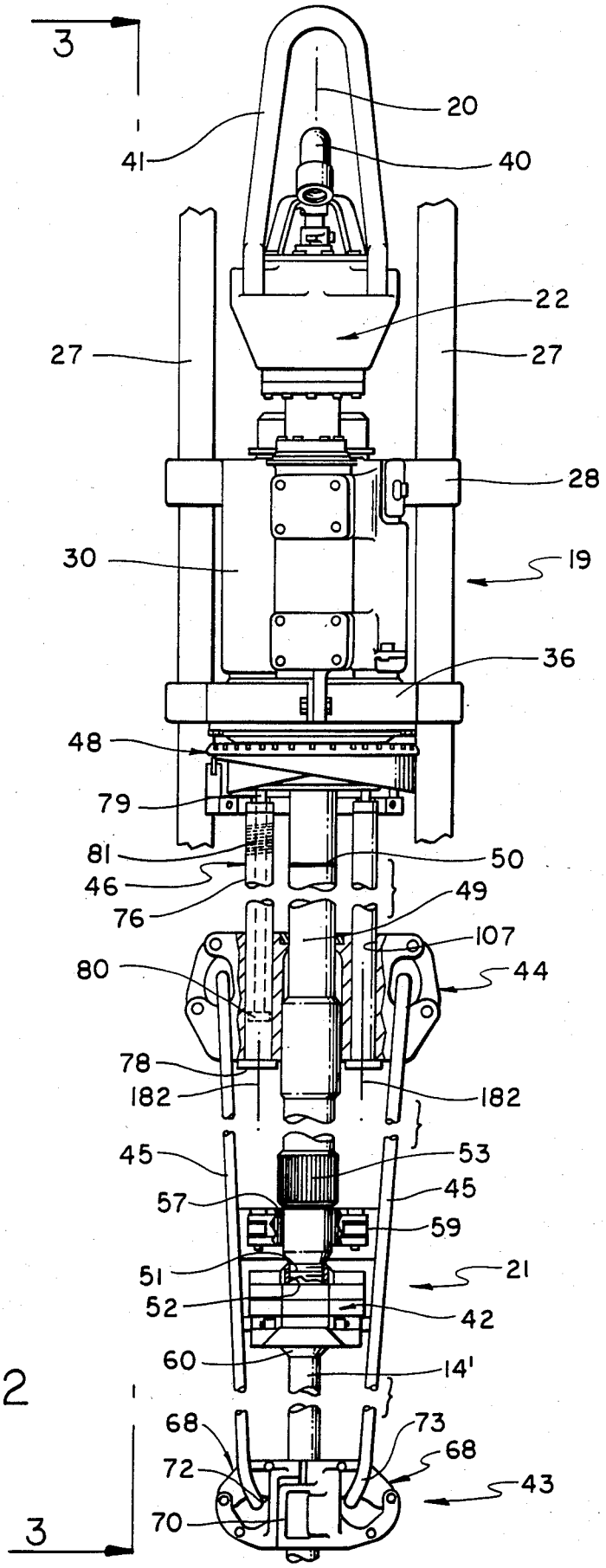
FIG. 2 is an enlarged view corresponding to a portion of FIG. 1, with certain elements illustrated in section.

Drilling fluid is introduced into the upper end of the tubular drill string through a swivel 22 connected to the upper end of top drive unit 19, with the swivel and connected top drive unit and pipe handler being suspended from a traveling block 23 which is suspended and moved upwardly and downwardly by a line 24 connected at its upper end to a crown block 25 and actuated by conventional powered draw works 26. The drilling unit 19, pipe handler 21 and connected parts are guided for vertical movement along axis 20 by two vertical guide rails or tracks 27 rigidly attached to derrick 11. The drilling unit 19 is attached to a carriage represented at 28 (see FIGS. 2 and 3) having rollers 29 engaging and located by rails 27 and guided by those rails for vertical movement upwardly and downwardly along the rails parallel to axis 20.

Figure 3:
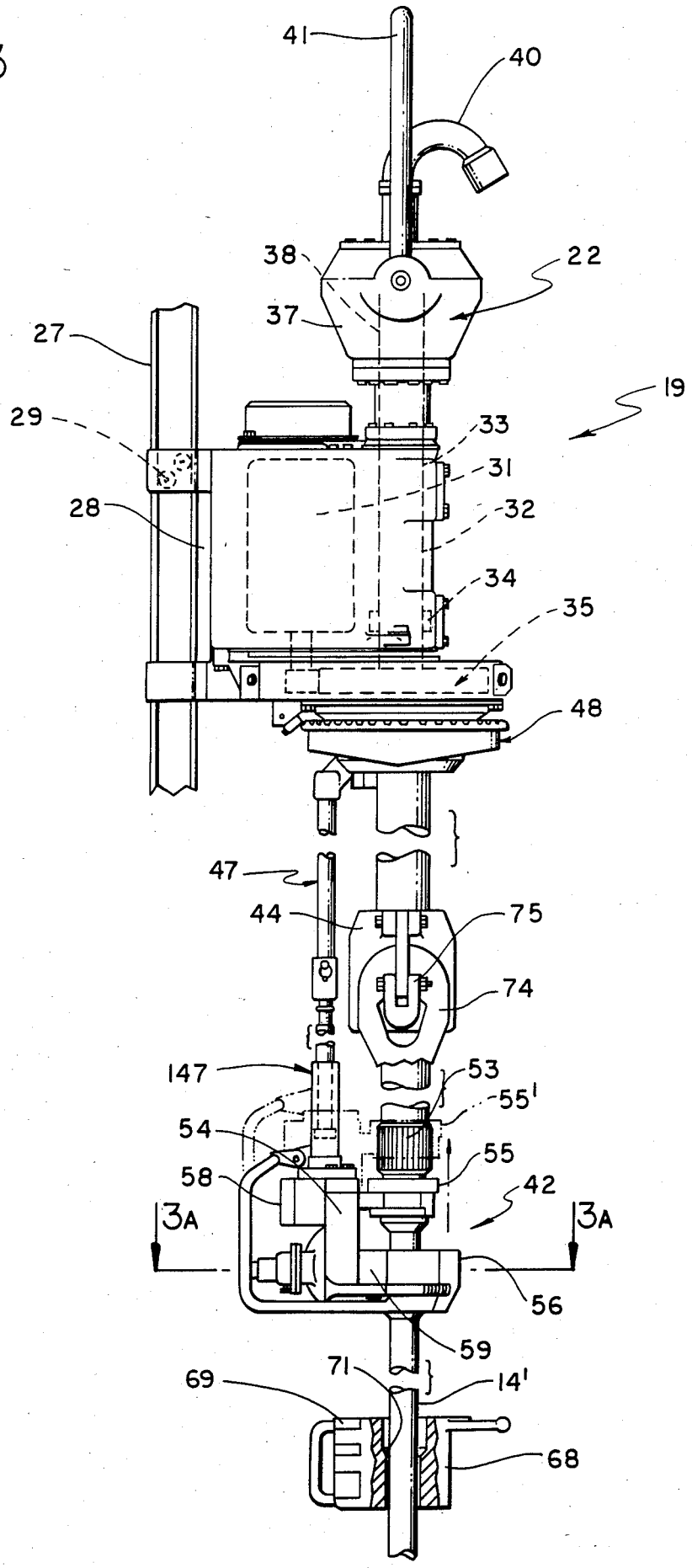
FIG. 3 is a side view taken on line 3—3 of FIG. 2.
Figure 3A:
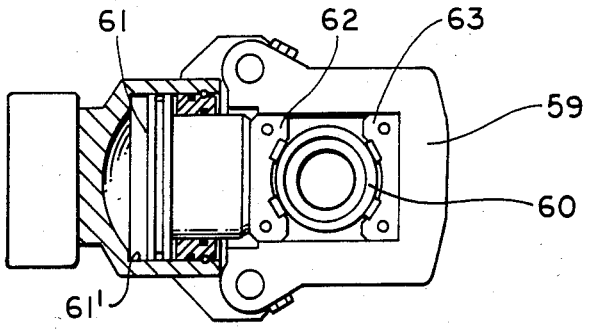
FIG. 3A is an enlarged horizontal section taken on line 3A—3A of FIG. 3.

Top drive unit 19 includes a housing 30 which is connected to carriage 28 in fixed position relative thereto during drilling and round tripping operations, and which contains a motor diagrammatically represented at 31 in FIG. 3. Housing 30 has a tubular vertical portion 32 within which a vertical tubular rotary element or pipe section 33 is journalled by bearings represented at 34 for rotation relative to the housing about the vertical axis 20 of the apparatus. The motor drives the tubular stem 33 rotatively about axis 20 through a speed reduction gear assembly represented diagrammatically at 35 and contained within a lower portion 36 of housing 30. Swivel 22 may be of conventional construction, including an outer body 37 within which a tubular element 38 connected to the upper end of the drilling unit stem 33 is rotatable, with the drilling fluid being fed downwardly through the swivel and tubular element 33 of the drilling unit into the drill string from a goose neck 40. The swivel is suspended from the traveling block by the usual bail 41.

Pipe handler 21 is suspended by and moves upwardly and downwardly with the drilling unit 19, and includes a torque wrench 42, an elevator 43 suspended from a carrier part 44 through two links 45, a pair of torque arrestors 46 for retaining part 44 against rotation, and a structure 47 for supporting and actuating torque wrench 42. The pipe handler may be connected to drilling unit 19 through an assembly 48 which retains the parts of the pipe handler against rotation relative to the drilling unit during a drilling operation but may permit rotation when the drill string is detached from stem 33 of the drilling unit and is being raised or lowered by elevator 43.

Pipe handling assembly 21 includes a hollow tubular pipe section or sub 49 threadedly connected to the bottom of power driven rotary stem 33 of the drilling unit at 50, and having an externally threaded pin portion 51 at its lower end connectible to the upper internally threaded end 52 of the upper section 14' of drill string 14, to enable the drilling unit to rotatively drive the drill string through the elements 33 and 49. Element 49 may have an externally splined portion 53 near its lower end for coaction with the torque wrench in making or breaking a connection with the upper end of the drill string.

Torque wrench 42 includes a rigid body structure 54 suspended from the top drive drilling unit by structure 47, and including an upper section 55 of the torque wrench and a lower section 56. Section 55 contains internal splines 57 which are located beneath and out of engagement with the splined portion 53 of element 49 in the position of FIGS. 2 and 3, and are movable upwardly into engagement with splines 53 in an upper position of the upper section of the torque wrench (see broken lines 55' in FIG. 3). In this upper position, parts 49 and 55 are keyed together by the splines to permit part 55 to apply torque about axis 20 to element 49. This torque is developed by two piston and cylinder mechanisms 58 (FIG. 3) having their cylinders rigidly connected to body 54 of the torque wrench and having their pistons connected to ears 59 of element 55 to rotate the element about axis 20. The torque wrench is power actuable upwardly and downwardly between its full line and broken line positions of FIG. 3 by a vertically extending piston and cylinder mechanism 147, whose piston is connected to the lower end of structure 47 by which the torque wrench is suspended and whose cylinder is connected to body 54 of the torque wrench.

The lower section 56 of the torque wrench includes a body 59 which is receivable about an upper internally threaded box end 60 of the top section of drill string 14 and is rigidly connected to body structure 54 of the torque wrench. A piston 61 contained within a cylinder 61' carried by body structure 54 is actuable by fluid pressure to force a gripping jaw structure 62 within body 59 of section 56 toward and away from a second gripping jaw structure 63 to grip the upper box end 60 and retain it against rotation while element 49 is turned in either direction by upper section 55 of the torque wrench to make or break the threaded connection between element 49 and box 60.

Elevator 43 is of any conventional contruction, including two body sections 68 pivoted together at 69 for opening and closing movement to enable the elevator to be placed about and removed from the drill pipe. A latching mechanism 70 releasably holds the two sections in their closed position, in which the elevator is capable of supporting the entire weight of the drill string, and for that purpose may have an internal annular upwardly facing shoulder 71 engageable with the enlarged joint end 60 at the upper end of the drill string to prevent downward movement of the drill string relative to the elevator. Alternatively, the elevator may be of a type containing slips for gripping and supporting the upper drill pipe section. The elevator may have loops 72 at its opposite sides engageable with the lower loop portions 73 of links 45, whose upper loops 74 engage loops 75 of carrier part 44 to suspend the elevator and drill string therefrom in certain operating conditions of the apparatus.

Each of the torque arrestors 46 includes an outer cylindrical body 76 (FIG. 2) which extends vertically through a passage in carrier part 44 and supports that carrier part by engagement of a lower flange 78 on body 76 with the underside of the carrier part. A rod 79 is connected at its upper end to the drilling unit and suspended thereby and projects downwardly into tubular body 76, and has an enlarged head 80 at its lower end bearing upwardly against a spring 81 in body 76 whose upper end bears upwardly against and supports body 76, so that the upper drilling unit and rod 79 support carrier part 44 yieldingly through spring 81. The two torque arrestor assemblies extend vertically along two vertical axes 182 which are parallel to the main vertical axis 20 of the apparatus and offset at diametrically opposite sides of that axis.

Figure 4:
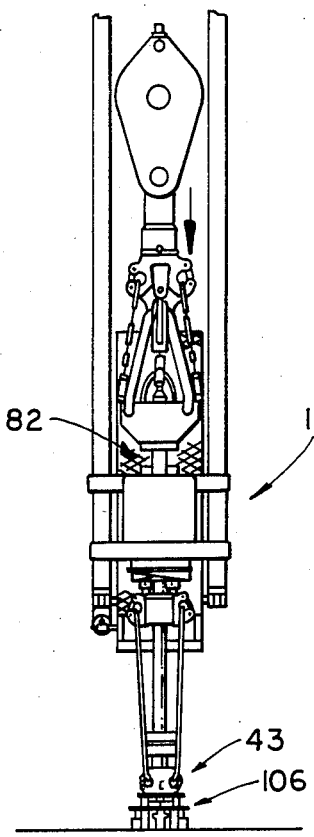
FIG. 4 is a portion of the apparatus of FIG. 1 after the drilling has been continued to a point at which the top drive drilling assembly has reached the rig floor.

The apparatus thus far described has been disclosed in prior applications. FIGS. 1 through 9 of the present application illustrate an improved way of utilizing that apparatus in conjunction with an elevated platform 82, walkway 83 and tong 84 to enable the drill string to be pulled off of the bottom of the well while a length of pipe is added to the string. The necessity for adding pipe of course occurs whenever the drilling unit reaches its lowermost position adjacent the rig floor as represented in FIG. 4. As the apparatus reaches the rig floor, elevator 43 preferably engages a slip assembly 106 supported by the rig floor within opening 13, and is restrained by that slip assembly against further downward movement as the drilling unit 19 and the string and torque wrench 42 continue their downward movement relative to elevator 43, links 45 and carrier part 44 until the torque wrench reaches the FIG. 4 position of engagement with the elevator. This relative vertical movement of the parts is permitted by downward sliding movement of outer bodies 76 of torque arrestors 46 relative to part 44 and within bores 107 in that part in which they are slidably received. After the hole has been drilled to the depth represented in FIG. 4, the draw works is actuated to elevate the drilling unit and connected string to the position represented in FIG. 5, in which the upper internally threaded box end 60 of the string is located at a level substantially above the level of rig floor 12, and in particular is high enough to prevent a person standing on the rig floor from reaching box end 60 to assist in making a connection thereto. In the FIG. 4 lowermost position of the drilling unit, the upper box end 60 of the string may be spaced about two feet above the level of the rig floor, and in the FIG. 5 position the box end 60 is preferably pulled upwardly at least about 10 feet above the rig floor, and desirably at least about 12 feet above the rig floor.

Figure 5:
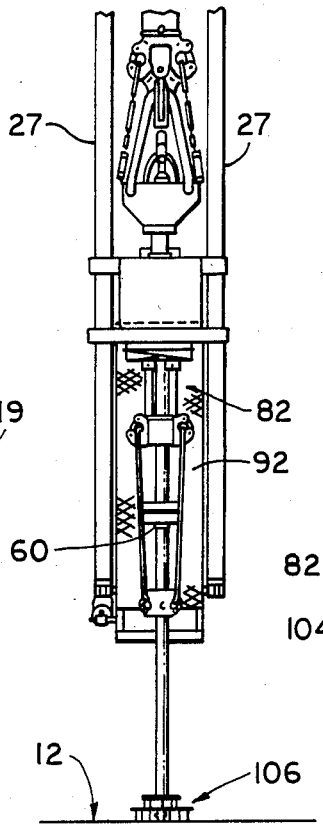
FIG. 5 shows a next step of the process, with the drilling string pulled upwardly a substantial distance, say 10 feet, from the FIG. 4 position.

Slip assembly 106 is actuated, preferably hydraulically or by other power, to grip the drill string and support it at the FIG. 5 level. Prior to such actuation, the slip assembly is of course in a released condition in which it does not grip the pipe or interfere in any way with vertical movement of the drill string by the drilling unit. The slip assembly may be of any conventional construction, especially illustrated as including a number of tapered slips 206 actuable upwardly and downwardly by cylinders 306 relative to a slip bowl 406 between a lower position in which the slips grip and support the well pipe and an upper released position in which the drill string can be moved upwardly and downwardly without interference by the slip mechanism.

After the slips have been set, torque wrench 42 is actuated to break the threaded connection between the upper extremity 60 of the drill string and rotary element 49 of the pipe handler. For this purpose, piston and cylinder mechanism 147 (FIG. 3) is actuated to elevate the torque wrench to the broken line position of FIG. 2 in which the upper section 55 of the wrench engages splines 53 of element 49, and the lower section 56 can grip box end 60 of the drill string, after which piston and cylinder mechanisms 58 are energized to turn section 55 relative to the drill string and thus break the threaded connection between the drilling unit and string. Motor 31 of the drilling unit is then energized to rapidly spin element 49 in a direction to completely disconnect it from the upper end of the string, freeing the drilling unit and pipe handling mechanism to be pulled upwardly (FIG. 6) to the top of the rig to pick up a length of pipe 14″ to be added to the string, as represented in FIG. 10. Stand 14″ is lifted by engaging elevator 43 with it, and then raising the top drive unit and the connected stand 14″ by upward movement of the traveling block, with the stand 14″ being swung inwardly into alignment with and above the upper end 60 of the string already in the hole, after which the top drive unit is lowered to stab the lower threaded end of element 49 into the upper internally threaded end of the new stand 14″, and to stab that stand into box end 60 (FIG. 11). The motor 31 of the top drive unit is then rotated in a direction to spin element 49 into section 14″ and spin section 14″ into box end 60, and simultaneously apply enough torque to fully make up the threaded connections at both the upper and lower ends of stand 14″. The drilling operation may then be continued to drill further into the hole, with downward advancement of the drill string and drilling unit while rotating the drill string and bit, until the apparatus again reaches the position of FIG. 4 at which the above discussed procedure is repeated to add another stand of pipe to the string.

Figure 6:
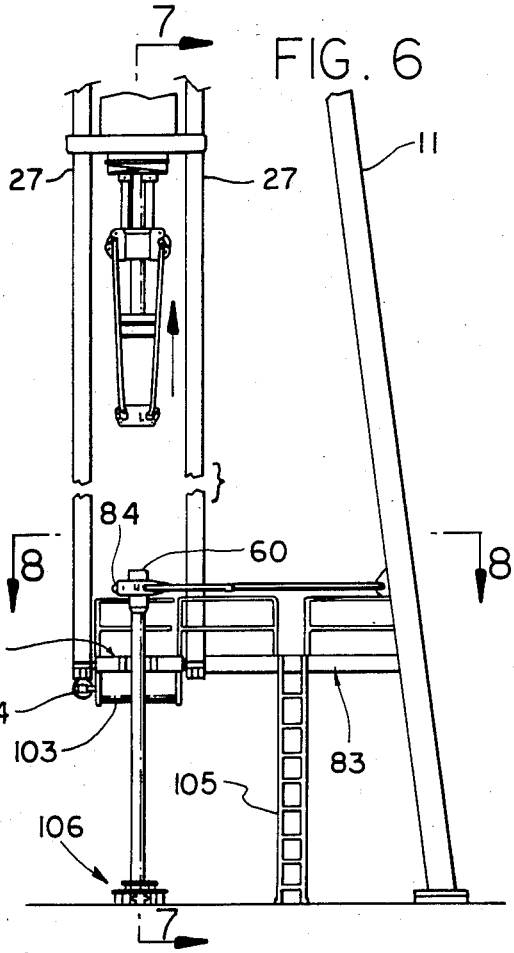
FIG. 6 shows a next step, in which the top drive drilling assembly has been detached from the drill string and is withdrawn upwardly, and the movable platform has been swung to its active position.
Figure 7:
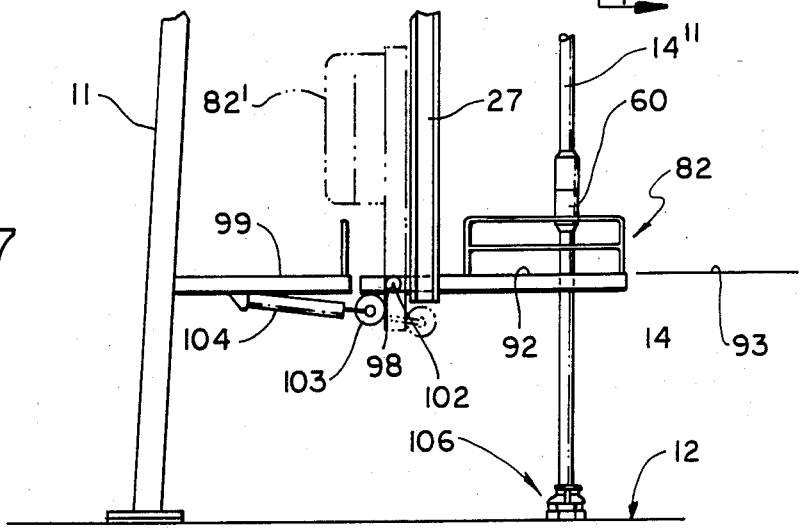
FIG. 7 is a vertical section taken on line 7—7 of FIG. 6.

The purpose of platform 82 and walkway 83 is to give a workman access to the upper end portion 60 of the drill string in its elevated position of FIGS. 5, 6 and 7, so that the workman may move tong 84 into engagement with box end 60 to prevent rotation of end 60 and the remainder of the string when the additional stand 14″ is rotated rapidly into engagement with end 60 as discussed above. The tong 84 may be of conventional construction, and is normally retained in a retracted position such as that represented at 84′ in FIG. 8, in which the tong is attached by a releasable connector 85 to a side rail 86 of walkway 83, or to any other convenient structure at a side of the well. A line 87 suspends the tong in the rig from any appropriate upper portion of the derrick, and in a relation allowing the tong to be swung between the active full line position of FIG. 8 and the inactive broken line position of that figure. A second line 88 is connected at opposite ends to the tong and to a stationary portion 89 of the rig, to prevent rotation of the tong and thus take the back-up torque developed in box end 60 as the threaded connections at the upper and lower ends of stand 14″ are made up. The gripping jaws 90 of the tong for retaining the pipe against rotation are of course adapted to be opened for removal of the tong from the pipe and retained in a closed gripping position by latching mechanism represented at 91.

Figure 8:
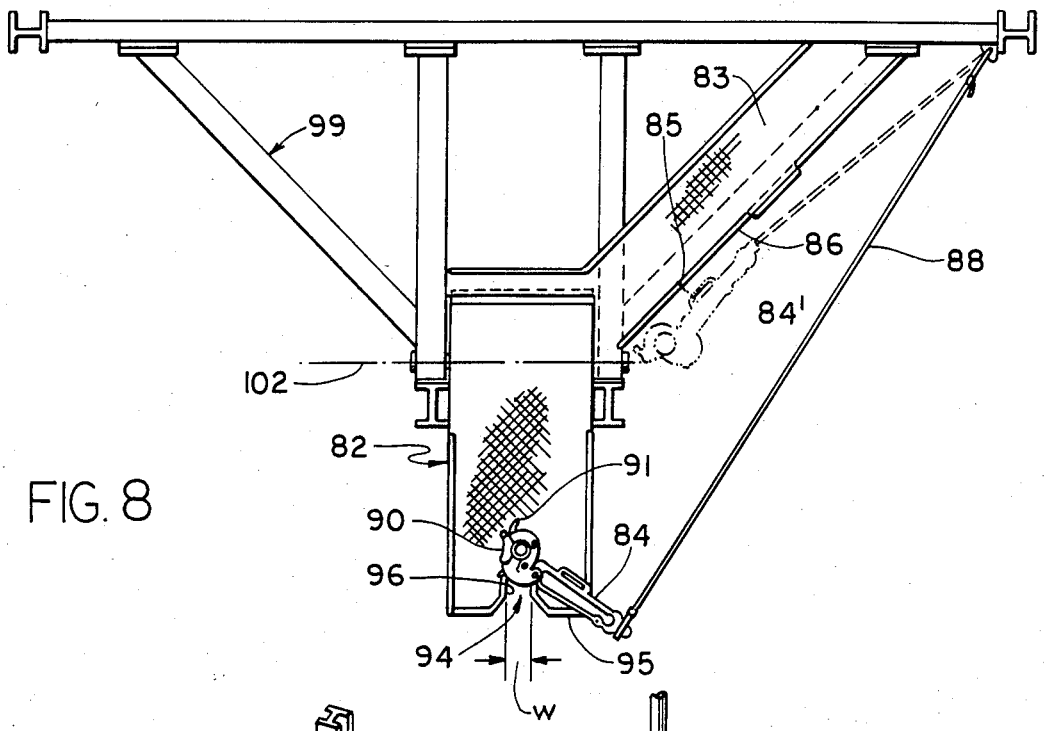
FIG. 8 is an enlarged horizontal section taken on line 8—8 of FIG. 6.
Figure 9:
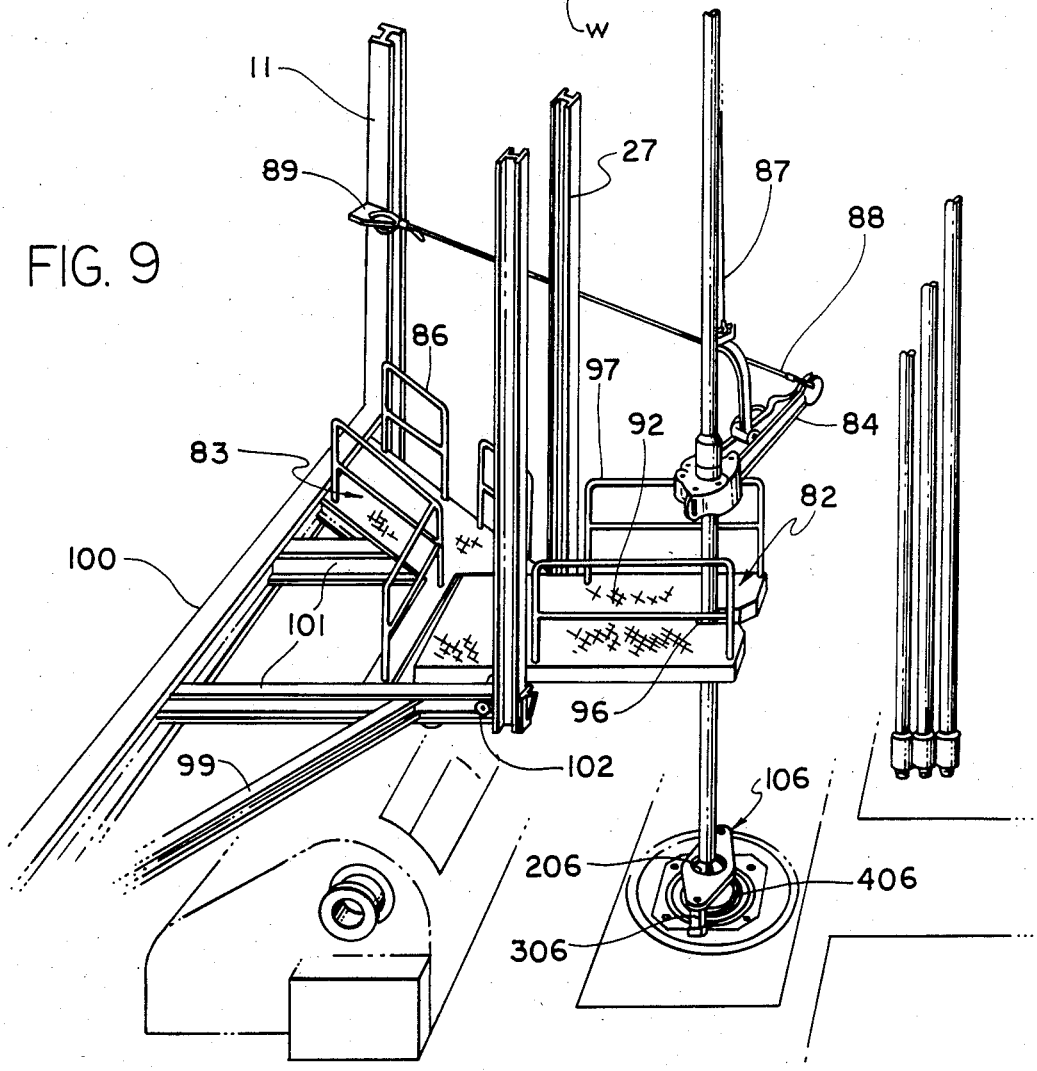
FIG. 9 is a fragmentary perspective representation of the apparatus in the condition of FIGS. 6 to 8.

During the actual drilling operation, the platform 82 is in the retracted inactive position represented in broken lines at 82′ in FIG. 7. The platform remains in this retracted position as the drilling is continued to the FIG. 4 condition, and as the drill string is pulled upwardly to the FIG. 5 position, and may also remain in that retracted position until the drilling unit has been disconnected from the upper end 60 of the drill string and pulled upwardly as represented in FIG. 6. After the drilling unit has been retracted upwardly, the platform may be swung inwardly and downwardly to the full line position of FIGS. 6 and 7. The upper surface 92 of the platform may be essentially planar and lie in a horizontal plane 93 in the active full line position of the platform. The platform may be essentially rectangular, as seen in FIG. 8, except for the provision of a cutaway or recess 94 formed in the edge of the platform which faces toward the drill string. This cutaway has a width w slightly greater than the diameter of the drill pipe, to closely receive the drill pipe in the active position of the platform, and has a depth inwardly away from edge 95 of the platform predetermined to allow the innermost portion 96 of the recess or notch to engage the well pipe and restrain it against movement leftwardly in FIGS. 7 and 9 during the joint make up operation. Side rails 97 project upwardly from opposite sides of the plaform.

The platform is mounted for its swinging movement by two aligned bearings 98, which may support the platform from a rigid frame structure 99 connected rigidly and stationarily to the rig derrick 11. The frame 99 may include two parallel members 101 projecting horizontally from a horizontal member 100 of the derrick and received at opposite sides of the platform to support the platform pivotally through bearings 98. The extremities of members 101 may be welded to the lower ends of rails 27. The axis 102 about which the platform swings extends horizontally, at a location slightly rearwardly of rails 27, so that in its retracted position (broken lines in FIG. 7), the platform extends essentially horizontally at a location just behind the vertical plane of the guide rails 27. A counterweight structure 103 is connected to the platform at the left side of its pivotal axis as viewed in FIG. 7, and has a weight just sufficient to counterbalance the rightwardly projecting weight of the main portion of the platform. The platform may be swung between its positions in any convenient manner, as by one or more piston and cylinder mechanisms 104 connected at one end to the stationary frame structure 99 and at its opposite end to the platform or connected counterweight.

Walkway 83 extends horizontally at the same level as platform 82 in its active full line position of FIG. 7. This walkway may extend at an angle away from the drill string as seen in FIG. 8, and may be provided with side rails 86 at opposite sides of the walkway except as those side rails are interrupted at the location of a ladder 105 on which a person may climb upwardly or downwardly between the level of the rig floor and the level of the walkway and platform.

To recapitulate briefly the preferred method which is followed in adding a pipe to the drill string with the apparatus illustrated in FIGS. 1 through 12, the drilling unit 19 and connected apparatus and drill string 14 are advanced downwardly along guide rails 27, with the drill string and bit being driven rotatably by the motor of the unit 19, and with this apparatus advancing downwardly through the position of FIG. 1 and ultimately to the FIG. 4 lowermost position adjacent the rig floor. During this drilling, platform 82 is in its retracted broken line position of FIG. 7, to avoid interference with the operation of the drilling equipment. When the drilling has progressed to the FIG. 4 condition, the drill string is pulled upwardly off of the bottom of the well, by elevation of the drilling unit and string to the FIG. 5 position, and the string is then suspended in that condition independently of the drilling unit by actuation of slip mechanism 106 to its active gripping condition. The drilling unit and the pipe handler mechanism suspended thereby may then be disconnected from the upper end 60 of the string by counterclockwise rotation of element 49 of the pipe handling mechanism by motor 31. Elevator 43 is opened and thus detached from the drill string, allowing the drilling unit and connected parts to be pulled upwardly as represented in FIG. 6. After the drilling unit and pipe handling mechanism have been pulled upwardly away from the upper end 60 of the string, plaform 82 is swung outwardly to the full line position of FIG. 8.

The drilling unit is pulled upwardly to the position of FIG. 10, and elevator 43 is engaged in supporting relation with a stand of pipe 14″ racked in the side of the derrick. The stand 14″ is then lifted by the drilling unit, and moved to a position above the drill string, after which the drilling unit is lowered to stab its stem 49 into stand 14″ and to stab that stand into the upper end 60 of the string (FIG. 11), with the threaded connections at the upper and lower ends of section 14″ then being made up by powered rotation of element 49.

While the stand 14″ is being picked up and moved to the FIG. 11 position, a workman may detach tong 84 from its broken line storage position of FIG. 8 and, walking out on platform 82 toward the drill string, move the tong to its full line position of FIG. 8 about the upper joint end 60 of the top section of the drill string. The tong in that position is closed about the pipe to grip its upper end 60. As the added length of pipe 14″ is then lowered into the upper end 60 of the drill string and rotated by the top drive unit, the tong retains the drill string against rotation, to fully make up the threaded connections at the upper and lower ends of section 14″. The tong may then be detached from the string and carried back to its inactive position, so that the platform 82 may be swung to its inactive condition to permit the drilling to progress downwardly until the drilling unit again reaches the rig floor.

FIGS. 13 through 19 illustrate a veriational arrangement which is in certain respects especially useful for enabling a drill string to be raised off of the bottom of a well when the rig which supports the string is mounted on a floating vessel. In this second arrangement, the rig includes a derrick **11*a* in which there are mounted two vertical parallel guide rails 27*a* similar to the rails 27 of the first form of the invention and mounting a top drive unit 19*a* and pipe handler 21*a* which may be identical with the pipe handler 19 and 21 respectively of the first form of the invention and are suspended and moved vertically by a line 24*a*. Unit 19*a* acts to support and drive rotatively a drill string 14*a* carrying a bit at its lower end. The rig floor 12*a* supports a power actuated slip mechanism 106*a* which is actuable between a gripping condition for supporting the well pipe 14*a*** and a released position in which the string can be moved upwardly and downwardly by the drilling unit.

Figure 13:
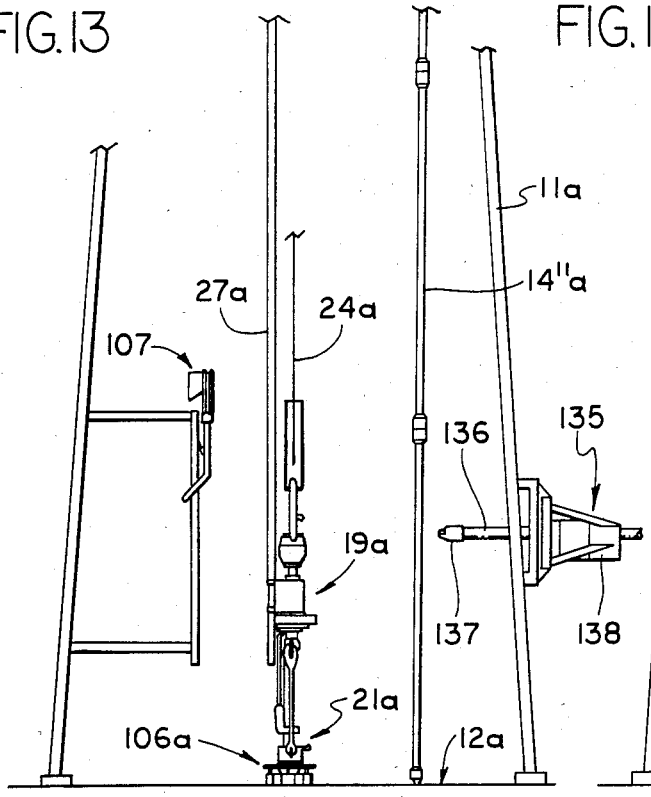
FIGS. 13, 14, 15 and 16 illustrate successive steps in a second method embodying the invention, utilizing a different type of back-up tool.
Figure 14:
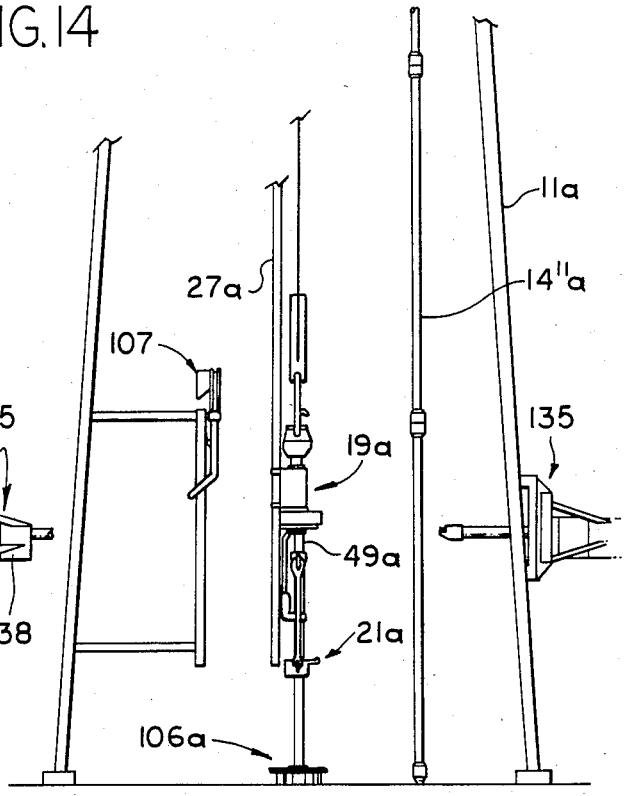

As in the first form of the invention, the drilling unit is progressively lowered, while rotating the drill string, to drill the hole, until the elevator engages slip assembly **106*a*, and the torque wrench of the pipe handler 21*a* moves downwardly relative to the elevator to the lowermost position of FIG. 13**, corresponding to the FIG.

4 position of the first form of the invention. After reaching that lowermost position adjacent the rig floor, the drilling unit is pulled upwardly by line 24*a* to the FIG. 14 position (corresponding to that of FIG. 5), and the drill string is supported independently of the drilling unit in that position by actuation of slip mechanism 106*a* to its gripping condition. In the FIG. 14 position, the upper end 60*a* of the drill string is high enough to be essentially inaccessible to a person standing on the rig floor, say 6 to 16 feet (preferably at least about 10 feet) above the rig floor, so that a person on the rig floor can not easily or conveniently move a back-up tong into gripping engagement with end 60*a* of the string.

Figure 15:
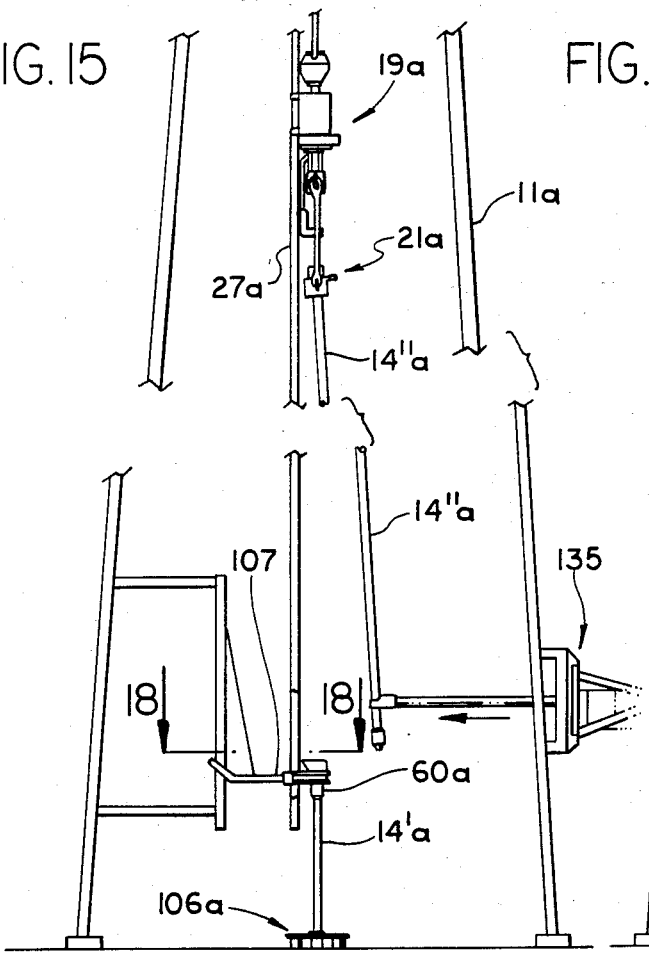
Figure 16:
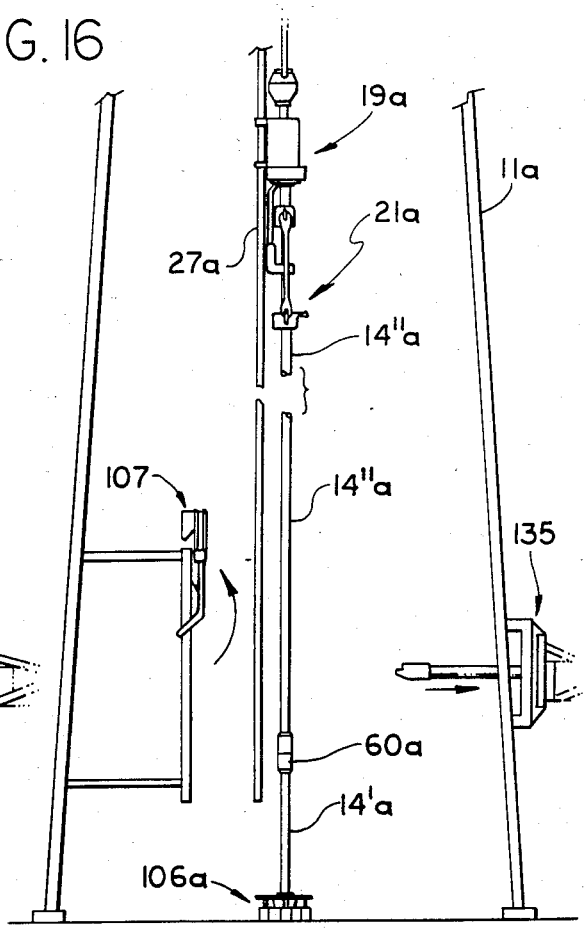

After the slip mechanism has been set, the pipe handler 21*a* is actuated to detach its stem 49*a* from the upper box end 60*a* of the drill string, and the drilling unit and pipe handler are pulled upwardly to the FIG. 15 position and connected to the upper end of a length of pipe 14″*a* to be received above the upper box end 60*a* of the top section of the drill string and then be lowered into that box end and rotated by the motor of the top drive unit to completely make up the threaded connections at the upper and lower ends of stand 14″*a*.

In FIGS. 13 through 19, there is substituted for platform 82, walkway 83, tong 84, and the related parts a unit 107 which acts to prevent rotation of the upper section 14′*a* of the drill string as the top drive unit rotates the add-on stand 14″*a* to connect it to the box end 60*a* of stand 14′*a*. Unit 107 includes a gripping tool 108 which is actuable to grip and release the well pipe and which is mounted by an arm 109 for movement upwardly and downwardly relative to a vertical support post 110 located slightly behind and between the two guide rails 27*a*. As seen in FIG. 18, post 110 may be of externally square horizontal section, and extend parallel to the vertical axis 20*a* of the well, and is appropriately mounted in fixed position relative to the derrick, as by provision of rigid connectors or frame elements 111 attached to portions of the derrick structure. Arm 109 has two spaced side plates 112 welded to its inner end and received at opposite sides of post 110, with two rollers 113 and 114 being mounted to these plates for rotation relative thereto about two parallel horizontal axes 213 and 214. The rollers are received at the front and rear sides respectively of post 110 and are engageable therewith in the FIG. 17 full line position of arm 109 to support that arm in a directly horizontally projecting condition, in which gripping device 108 is located properly to grip the vertical well pipe and retain it against rotation.

Figure 17:
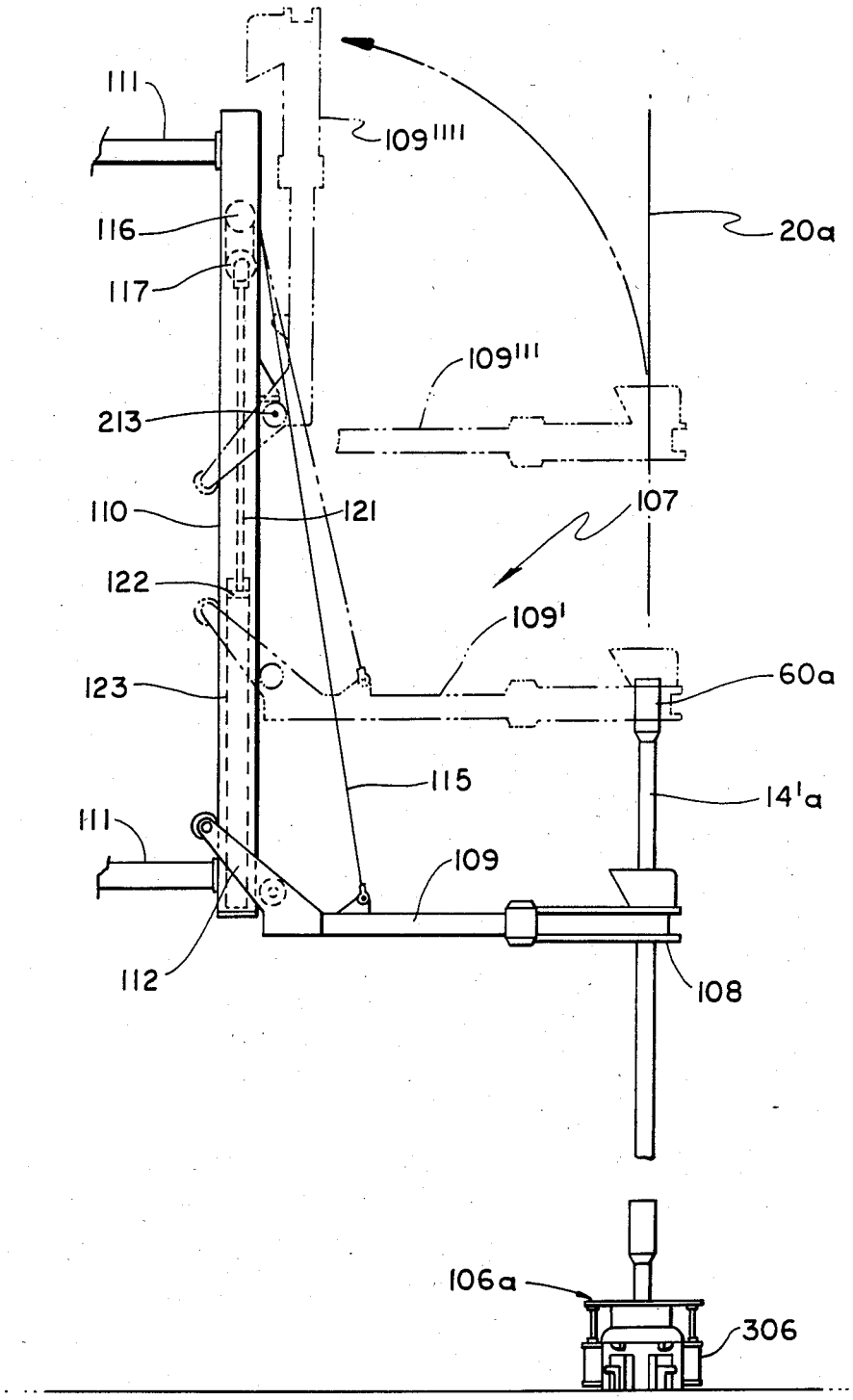
FIG. 17 is an enlarged side elevational view corresponding to a portion of FIG. 15, showing the back-up tool in a lower position than in FIG. 15.

The arm 109 and carried tool 108 are actuable vertically along the post, to any of the positions represented in FIGS. 17 and 18 or any intermediate positions, by a flexible cable or line 115, which extends about the upper side of a sheave 116 mounted rotatably within the interior of the hollow post 110. After such extension about sheave 116, line 115 extends downwardly and then about the underside of a second sheave 117, and then upwardly at 118 for connection at 119 to a bracket 120 within the post which may also support the first mentioned sheave 116. Sheave 117 may be mounted rotatably to the upper end of a piston rod 121, for actuation upwardly and downwardly by a piston 122 contained within a vertical cylinder 123 mounted at a fixed location within the lower portion of column 110. Thus, by downward fluid actuation of piston 122 within the cylinder, sheave 117 is pulled downwardly to exert an upward force through line 115 on arm 109 and thereby pull it upwardly along the column. In an uppermost position of arm 109 (see broken line position 109‴ in FIG. 19), roller 113 engages a rigid stop element 124 which is secured to the exterior of post 110 in fixed position, thus preventing further upward movement of roller 113 so that as line 115 exerts continued upward force on arm 109 it swings the arm pivotally about the horizontal axis 213 of roller 113 and from the position 109‴ of FIG. 19 to the position 109⁗ of FIG. 17. In this final condition 109⁗, arm 109 projects directly vertically upwardly at a location between or slightly rearwardly of the two guide rails 27*a*, and at that location is not engaged by any part of the drilling unit or pipe handling mechanism as they move upwardly and downwardly past arm 109 during a drilling operation. The carriage of the drilling unit and other parts of that unit are designed to avoid any contact with arm 109 in its upwardly projecting retracted inactive position represented at 109⁗ in FIG. 17.

The gripping tool 108 carried by arm 109 may include two similar jaws 126 mounted by bearing structures 127 for pivotal movement relative to arm 109 about two spaced parallel vertical axes 128 between the full line positions of FIG. 18 in which gripping elements 129 carried by the jaws grip and prevent rotation of the upper end of the drill string, and the broken line positions of FIG. 18 in which the jaws are open enough to allow them to move laterally and upwardly out of engagement with the upper end of the pipe. The jaws are pivotally actuated relative to one another and relative to arm 109 by appropriate means, such as a pair of piston and cylinder mechanisms 130, whose cylinders are connected at 131 to the jaws and whose pistons are pivotally connected at 132 to arm 109. At the upper sides of the jaws, arm 109 may carry a stabbing guide 133, having a side wall 134 which tapers downwardly to engage the lower pin end of a stand of pipe being added to the string, and deflect that pipe laterally into the upper box end 60*a* of the drill string already in the hole.

In conjunction with the apparatus as thus far described, I may also utilize a conventional well pipe racking tool as represented at 135 in certain of the figures, for gripping the lower end of the add-on stand of pipe and moving it to a position to be properly stabbed into the upper end of the drill string. This unit 135 may include an arm 136 having a tool 137 at its end for engaging and holding the lower end of the stand of pipe to be added to the string, and may also include powered actuating mechanism represented at 138 for moving arm 136 and the engaged pipe end in any desired manner to bring the pipe into alignment with the well axis.

In using the apparatus of FIGS. 13 through 19, the drilling unit is gradually lowered while rotating the drill string and the bit to drill a portion of the well bore, with this drilling continuing until the apparatus reaches the lowermost position of FIG. 13 at the rig floor. During the drilling, the back-up unit 107 is in its fully retracted position represented at 109⁗ in FIG. 17, and thus does not interfere in any way with drilling. After reaching the FIG. 13 position, the drilling unit and string are pulled upwardly off of the bottom of the well and to the position of FIG. 14, at which slip mechanism 106*a* is set to support the pipe, and the drilling unit is then detached from the upper end of the drill string and moved upwardly to pick up the add-on stand 14″*a*. After the drilling unit and carried pipe handler are above the level of unit 107, piston 122 is actuated upwardly to allow arm 109 to first swing outwardly about axis 213 from the position 109'''' of FIG. 17 to the position 109''' of FIG. 19. Further upward movement of the piston allows the arm 109 in its horizontal condition to move gradually downwardly to exactly the right level for gripping and engaging the upper box end 60*a* of the drill string. Movement of the piston is halted at that position (for example position 109' of FIG. 17), and the jaws 126 are then actuated to grip the upper end 60*a* of the pipe and positively retain it against rotation. With the drill string thus retained, the additional length of pipe 14''*a* is lowered by the drilling unit into stabbing guide 133, and is directed by that guide into proper engagement with box end 60*a*, so that by rotation of stand 14''*a* by the drilling unit the threaded connections at the upper and lower ends of that stand can be made up to a tight condition. The jaws 126 are then actuated to release the pipe, and arm 109 is pulled upwardly by piston 122 to engage stop 124 and then swing to the vertical retracted position 109'''', in which it remains as another portion of the well is drilled by downward movement of the drilling unit until it again reaches the FIG. 13 position adjacent the floor. The capacity of unit 107 to shift its arm 109 vertically to different positions enables that arm to be properly located for engagement with the upper end of the drill string in any setting thereof, and without requiring that the drill string be supported precisely at any desired level on each use of the unit 107. The arrangement illustrated permits vertical adjustment of arm 109 and retraction of arm 109 by a single piston and cylinder mechanism.

While certain specific embodiments of the present invention have been disclosed as typical, the invention is of course not limited to these particular forms, but rather is applicable broadly to all such variations as fall within the scope of the appended claims.

I claim:

1. Well apparatus comprising:

a back-up tool for holding the upper end of a string of pipe against rotation as an additional section of pipe is connected thereto; and powered means for moving said tool to engage said upper end of the string;

said powered means being operable through a predetermined range of movement, and acting to move said back-up tool vertically during an inital portion of said range of movement and then move the tool between an active position at the axis of the well and a retracted position offset to a side of said axis at the end of said range of movement.

2. Well apparatus as recited in claim 1, including a vertically extending guide structure to which said back-up tool is mounted for guided upward and downward movement and for swinging movement from said active position to said retracted position, and stop means for limiting said vertical movement of the back-up tool along said guide structure and initiating said swinging movement thereof.

3. Well apparatus as recited in claim 1, including a guide structure guiding said back-up tool for movement upwardly and downwardly to different levels, first and second roller means engaging said guide structure to guide the tool for movement upwardly and downwardly in said active position, and stop means engageable with one of said roller means for limiting movement thereof and initiating swinging movement of the tool about essentially said one roller means and to said retracted position.

4. Well apparatus as recited in claim 1, including a vertically extending guide structure, first and second roller means bearing in opposite directions against said guide structure when the back-up tool is in said active position thereof to guide the tool for upward and downward movement, said powered means including piston and cylinder means for actuating said tool upwardly and downwardly along said guide structure, there being stop means for limiting vertical movement of one of said roller means at a predetermined location and in a relation thereafter causing swinging movement of said back-up tool essentially about said one roller means to move the back-up tool between said active and retracted positions thereof.

5. Well apparatus as recited in claim 1, in which said back-up tool includes relatively movable jaws engageable with opposite sides of said upper end of the drill string for holding it against rotation and actuable between active and released conditions.

6. Well drilling apparatus, comprising;

a rig having a rig floor;

a top drive unit including a rotary drive element detachably connectible to an upper threaded end of a drill string and a motor for driving said element to turn the string and drill a well, said unit being movable downwardly with the string to a position in which said upper end of the string is in a bottom position thereof near the rig floor;

means for supporting said string independently of the top drive unit so that said element of the top drive unit can be detached from the string and an additional section of pipe can be connected between the top drive unit and said upper threaded end of the string and be rotated into threaded engagement with the upper threaded end of the string;

a back-up tool for engaging said upper end of the drill string and preventing rotation thereof as said pipe section is connected thereto;

means mounting said back-up tool for movement between an inactive position offset to a side of the drill string and an active position of gripping engagement with said upper threaded end of the string, with said upper threaded end raised above said bottom position near the rig floor and to a higher level at which said upper threaded end of the string is essentially inaccessible from the rig floor; and said mounting means being constructed to mount said back-up tool for swinging movement to said inactive position and for vertical shifting movement; and a common power actuated unit for effecting both said swinging movement and said vertical shifting movement of the tool.

7. Well drilling apparatus as recited in claim 6, in which said mounting means include an arm carrying said back-up tool near an end thereof and mounted for swinging movement in a manner shifting said tool between its inactive and active positions.

8. Well drilling apparatus, comprising:

a rig having a rig floor;

a top drive unit including a rotary drive element detachably connectible to an upper threaded end of a drill string and a motor for driving said element to turn the string and drill a well, said unit being movable downwardly with the string to a position in which said upper end of the string is in a bottom position thereof near the rig floor;

means for supporting said string independently of the top drive unit so that said element of the top drive unit can be detached from the string and an additional section of pipe can be connected between the top drive unit and said upper threaded end of the string and be rotated into threaded engagement with the upper threaded end of the string;

a back-up tool for engaging said upper end of the drill string and preventing rotation thereof as said pipe section is connected thereto; and means mounting said back-up tool for movement between an inactive position offset to a side of the drill string and an active position of gripping engagement with said upper threaded end of the string, with said upper threaded end raised above said bottom position near the rig floor and to a higher level at which said upper threaded end of the string is essentially inaccessible from the rig floor;

said mounting means including a vertically extending support structure, and an arm carrying said tool at an end thereof and mounted to said support structure for both vertical and swinging movements relative thereto.

9. Well drilling apparatus as recited in claim 8, in which said back-up tool in said active position thereof engages said upper threaded end of the string at a level at least about 10 feet above said rig floor to retain said upper threaded end against rotation at that level.

10. Well drilling apparatus, comprising:

a rig having a rig floor;

a top drive unit including a rotary drive element detachably connectible to an upper threaded end of a drill string and a motor for driving said element to turn the string and drill a well, said unit being movable downwardly with the string to a position in which said upper end of the string is in a bottom position thereof near the rig floor;

means for supporting said string independently of the top drive unit so that said element of the top drive unit can be detached from the string and an additional section of pipe can be connected between the top drive unit and said upper threaded end of the string can be rotated into threaded engagement with the upper threaded end of the string;

a back-up tool for engaging said upper end of the drill string and preventing rotation thereof as said pipe section is connected thereto;

means mounting said back-up tool for movement between an inactive position offset to a side of the drill string and an active position of gripping engagement with said upper threaded end of the string, with said upper threaded end raised above said bottom position near the rig floor and to a higher level at which said upper threaded end of the string is essentially inaccessible from the rig floor;

said mounting means including a vertically extending support structure, and an arm carrying said tool at an end thereof and mounted to said support structure for both vertical and swinging movements relative thereto; and a power unit operable through a predetermined range of movement and acting during such movement to initially move said arm vertically and then swing the arm pivotally.

11. Well drilling apparatus, comprising:

a rig having a rig floor;

a top drive unit including a rotary drive element detachably connectible to an upper threaded end of a drill string and a motor for driving said element to turn the string and drill a well, said unit being movable downwardly with the string to a position in which said upper end of the string is in a bottom position thereof near the rig floor;

means for supporting said string independently of the top drive unit so that said element of the top drive unit can be detached from the string and an additional section of pipe can be connected between the top drive unit and said upper threaded end of the string and be rotated into threaded engagement with the upper threaded end of the string;

a back-up tool for engaging said upper end of the drill string and preventing rotation thereof as said pipe section is connected thereto;

means mounting said back-up tool for movement between an inactive position offset to a side of the drill string and an active position of gripping engagement with said upper threaded end of the string, with said upper threaded end raised above said bottom position near the rig floor and to a higher level at which said upper threaded end of the string is essentially inaccessible from the rig floor;

said mounting means including a vertically extending support structure, an arm carrying said back-up tool and mounted to said support structure for vertical movement therealong and for swinging movement about a generally horizontal axis between a horizontally projecting position and a generally vertical inactive position;

a piston and cylinder unit;

a line actuable by said piston and cylinder unit and acting through a predetermined range of movement to initially pull said arm upwardly while in said horizontal position and then swing the arm upwardly to said vertical position; and a stop for limiting said upward movement of the arm and initiating said swinging movement thereof.

12. Well drilling apparatus as recited in claim 11, in which said tool includes gripping jaws carried at an end of said arm, and power actuated means for swinging said jaws relative to one another between gripping and released conditions.

* * * * *